US008105254B2

(12) United States Patent
Guantera et al.

(10) Patent No.: US 8,105,254 B2
(45) Date of Patent: Jan. 31, 2012

(54) APPARATUS AND METHOD FOR THE CONDITIONING OF MUSCULAR FIBRILS REACTION COORDINATION CAPACITY BY MEANS OF A PRESSURE WAVE, AND AESTHETIC AND THERAPEUTIC APPLICATION THEREOF

(75) Inventors: Giuseppe Guantera, Taranto (IT); Claudio Polidori, Taranto (IT)

(73) Assignee: Vissman S.R.L., Rome (IT)

( * ) Notice: Subject to any disclaimer, the term of this patent is extended or adjusted under 35 U.S.C. 154(b) by 1106 days.

(21) Appl. No.: 11/792,386

(22) PCT Filed: Dec. 6, 2005

(86) PCT No.: PCT/IT2005/000715

§ 371 (c)(1),
(2), (4) Date: Aug. 20, 2007

(87) PCT Pub. No.: WO2006/061867

PCT Pub. Date: Jun. 15, 2006

(65) Prior Publication Data

US 2008/0064994 A1 Mar. 13, 2008

(30) Foreign Application Priority Data

Dec. 6, 2004 (IT) ..... RM2004A0597

(51) Int. Cl.
*A61H 1/00* (2006.01)
*A61H 7/00* (2006.01)
*A61H 19/00* (2006.01)

(52) U.S. Cl. ..... 601/149; 601/46

(58) Field of Classification Search ..... 601/15, 601/46, 48, 148–152; 602/13
See application file for complete search history.

(56) References Cited

U.S. PATENT DOCUMENTS

| | | | | |
|---|---|---|---|---|
| 3,878,839 | A * | 4/1975 | Norton et al. | 601/152 |
| 4,865,020 | A * | 9/1989 | Bullard | 601/152 |
| 4,955,366 | A * | 9/1990 | Uchiyama et al. | 601/4 |
| 5,072,724 | A | 12/1991 | Marcus et al. | |
| 5,350,352 | A * | 9/1994 | Buchholtz et al. | 601/4 |
| 5,672,148 | A * | 9/1997 | Maunier | 601/148 |
| 5,941,838 | A * | 8/1999 | Eizenhofer | 601/2 |
| 2005/0187071 | A1 | 8/2005 | Yamashita et al. | |

FOREIGN PATENT DOCUMENTS

| | | |
|---|---|---|
| EP | 1095670 | 5/2001 |
| FR | 2652499 | 4/1991 |
| RU | 1797494 | 2/1993 |

OTHER PUBLICATIONS

International Search Report, Apr. 11, 2006.

* cited by examiner

*Primary Examiner* — Kristen Matter
(74) *Attorney, Agent, or Firm* — Hedman & Costigan, P.C.

(57) ABSTRACT

Apparatus and method for the conditioning of muscular fibrils by means of the application to a muscle in isometric contraction, a succession of mechanical pulses, where the apparatus includes means for the production of pressure pulses, means for the application of said pressure pulses on the epidermis adjacent the muscle and means for the transmission of said pulses from said means for the production of pressure pulses to said application means, wherein said application means and said means for the transmission of said pulses from said production means to said application means comprise a closed circuit inside which a compressed fluid or a substantially uncompressible fluid is present.

13 Claims, 11 Drawing Sheets

APPARATUS AND METHOD FOR THE CONDITIONING OF MUSCULAR FIBRILS REACTION COORDINATION CAPACITY BY MEANS OF A PRESSURE WAVE, AND AESTHETIC AND THERAPEUTIC APPLICATION THEREOF

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION

1) Field of the Invention

The present invention concerns an apparatus for the conditioning of muscular fibrils reaction coordination capacity by means of a pressure wave, and aesthetic and therapeutic application thereof.

2) Description of Related Art

In the living being, the locomotor system constitutes one of the fundamental hinges of its existence. It is constituted by the skeleton, composed by a complex osseous system mainly articulated and by striated muscles constituting the motor thereof or, more correctly the motors, since muscles are distributed by districts and each muscle is appointed to carrying out a definite movement.

The set of the possible movements is determined by the coordination of the action of one or more muscles in different districts, action accomplished through contraction or relaxation caused by electric signals, produced by the central nervous system by means of voluntary or reactive pulse, which reach the neuromuscular receptors and produce the contraction or extension of the myofibrils that constitute the muscular structure.

The work developable by a muscle depends on its mass, its training and its coordination capacity of the reaction of the single muscle fibrils with respect to the original motor exciter pulse. Recent studies demonstrated that this last condition is priority in order to maintain optimal muscular tonus, work capacity and resistance to fatigue.

The optimization capacity of the motor pulse and the coordination of the myofibrils response to the stimulus can be obtained in sane subjects in a natural way by means of exercises and trainings asking for very long times.

As far as carriers of pathologies of different nature is concerned, comprising those arising from injuries of the central nervous system, said pathologies can make it difficult or impossible the obtaining, even only acceptable, of the response of the muscular tissue to the stimulus through physical exercise.

A first, partial solution of said problem is constituted by electrical stimulation devices, i.e. devices provided of one or more electrical applicators, powered by a suitable generator, which can be positioned in direct contact with the skin of the patient in proximity of the muscle to be treated. The electric pulse, caused by the generator and transmitted to the muscle through the applicators, stimulates in the muscle a succession of involuntary contractions, in other words forces the muscles to an outside induced "training".

However, the results obtained with these devices have some limitations, due to the fact that the produced electric stimulus can involve only the most superficial muscles. A consequence of this feature is that the patient, after the termination of the treatment by means of this kind of devices, in any case is compelled to perform a physical activity 20% higher than before the treatment, otherwise the entire cycle of treatment is invalidated (cycles of at least thirty therapy sessions, repeatable countless times). Further, said treatments allow obtaining the increasing of the so-called power module, or the muscle capacity to overcome a negative resistance expressed in kg is very low, about 8-12%.

In order to solve this problem, apparatuses were realized to replace the external application of an electric stimulus with the application of a mechanical or electromechanical stimulus to the muscle. Such apparatuses expose the muscle to a stimulus of such features to induce an improvement of the coordination of the muscle fibrils reaction with respect to the given pulse.

In particular, already in 1978, the space administrations of the United States and of the Soviet Union used the vibration's action in order to obtain the astronauts physical conditions recover after the return from space missions. Americans used a vibrating footboard, while Russians hanged astronauts to a vibrating pivot, after slinging them like for a parachute.

At present, the most commonly used devices for normal applications having therapeutic or aesthetic purpose more simply provide for a mechanical or electromechanical pulse generator having a variable frequency and at least an applicator, which is positioned in direct contact with the skin, in correspondence with the muscle to be treated, said generator and said applicator being connected by means of a system providing for the transmission of the impulse.

In particular, devices are known where this kind of stimulus is given by means of an applicator provided with a plurality of sticks acting with light knocks directly on the skin of the patient, in proximity of the muscle to treat.

This first kind of device was later replaced by devices where a pressure impulse is transmitted by the generator to a volume of air that, through the transmission system, essentially constituted by pneumatic pipes, extends from the generator down to a transducer, namely a hollow body opened on one side, constituting the applicator. The correct application of this device provides for the open section of the transducer to be positioned on the skin of the person undergoing the treatment in such a way to retain the air inside the device by being substantially airtight.

Nevertheless, the known embodiments are affected by a series of drawbacks; in particular, because of their own typology, they have a fundamental limit, can only be devoted to treat a single muscle at a time.

In fact, the known devices incur in difficulties in the transmission of the pressure pulse, fundamentally involving a progressive lowering of the pulse amplitude, from the generator down to the applicator. This is due to the methods of pulse transmission used up to now.

Further, the known devices does not allow to apply impulses of high amplitude on the muscle since, if said impulses overcome the compression capacity of the air, the transducer is taken off from the skin and the air escape towards the outside. The repeating of these taking off of the transducer, takes the same frequency of the transmitted pulse, at first causes a reddening of the skin and, after, can even arrive to cut it.

At present, the most commonly used devices for normal applications having therapeutic or aesthetic purpose more simply provide for a mechanical or electromechanical pulse generator having a variable frequency and at least an applicator, which is positioned in direct contact with the skin, in correspondence with the muscle to be treated, said generator and said applicator being connected by means of a system providing for the transmission of the impulse.

In particular, devices are known where this kind of stimulus is given by means of an applicator provided with a plurality of sticks acting with light knocks directly on the skin of the patient, in proximity of the muscle to treat.

This first kind of device was later replaced by devices where a pressure impulse is transmitted by the generator to a volume of air that, through the transmission system, essentially constituted by pneumatic pipes, extends from the generator down to a transducer, namely a hollow body opened on one side, constituting the applicator. The correct application of this device provides for the open section of the transducer to be positioned on the skin of the person undergoing the treatment in such a way to retain the air inside the device by being substantially airtight.

Nevertheless, the known embodiments are affected by a series of drawbacks; in particular, because of their own typology, they have a fundamental limit, namely can be devoted to treat a single muscle at a time.

In fact, the known devices incur in difficulties in the transmission of the pressure pulse, fundamentally involving a progressive lowering of the pulse amplitude, from the generator down to the applicator. This is due to the methods of pulse transmission used up to now.

Further, the known devices does not allow to apply impulses of high amplitude on the muscle since, if said impulses overcome the compression capacity of the air, the transducer is taken off from the skin and the air escape towards the outside. The repeating of these taking off of the transducer, takes the same frequency of the transmitted pulse, at first causes a reddening of the skin and, after, can even arrive to cut it.

As far as the pressure pulses production is concerned, different systems are used in the known devices. In particular, according to one of these systems, the pressure pulse is produced by a piston running inside a cylinder, moved by a system constituted by a connecting rod and by a driving handle connected by a rotary motor. Alternatively, a system constituted by a connecting rod and by a driving handle, connected by a rotary motor, can act on a membrane, which is forced to oscillate inside a pneumatic chamber, each oscillation causing a compression of the air present in the portion of the pneumatic chamber that is addressed to the transmission means.

The two described systems are equivalent for function and yield. Theoretically, they have the advantage of maintaining the pulse amplitude at a constant value, independently from the applied frequency, but, since this depends on the motor rotation velocity, in a ratio of one Hertz for each turn, they have big limitation as far as the maximum reachable frequency is concerned. In fact, in order to reach a pulse frequency of only 50 Hz, motor rotary regimes of 3000 rounds per minute are required.

Therefore, in practice, these pulse generation systems do not allow to produce for the production of oscillations having simultaneously the sufficient frequency and amplitude, the determination of a compromise amongst these two quantities becoming necessary. Since the frequency of the oscillations is directly influenced by the kind of treatment to which the muscle to be treated has to be submitted, the pulse amplitude is often sacrificed to the advantage of frequency.

This limit is further amplified, as it was already seen, by the pulse transmission method, because of the compressibility of the used transmission fluid, namely the air, and of the friction effect produced the quick movements of the pulse transmission fluid in contact with the walls of the transmission conduits, causes a further damping of the wave amplitude.

BRIEF SUMMARY OF THE INVENTION

In order to solve these prior art problems, according to the present invention, an apparatus and a method are proposed for the treatment of one or more muscles, or of a same muscle in different places, by means of the application of a mechanical vibration, namely a series of pressure pulses whose frequency can be modulated according to the necessities, due to the oscillation of a column of a fluid in correspondence of the muscles intersection spots, in proximity of tendons, where the mechanical neuroreceptors of the corresponding muscles are concentrated.

The pulse generator according to the invention provides for particulars schemes allowing obtaining oscillation frequency even if very high, without jeopardizing the amplitude of the produced vibration. Further, the pulses transmission system from the generator to the transducer allows for the reduction to the minimum of the damping of the transmitted wave amplitude.

In particular, in order to activate the connection circuit between muscle and brain, the muscle (or muscles) to which the treatment according to the present invention is applied, must be placed in a light isometric contraction.

In a more specific way, the solution according to the present invention aims at providing an apparatus and a method that can induce, in a very short time, in the neuromuscular system of sane persons, the optimization of tonus and a considerable increase of the force and resistance in physical exercise. Such feature of the device and method according to the present invention comes out to be particularly desirable in the case of athletes, who can obtain very good results by reducing training periods. The optimization of muscular tonus further allows obtaining desirable results also from an aesthetic point of view.

The same apparatus, applied according to a different methodology, further allows carrying out rehabilitative therapies with interesting functional recovery on persons affected by pathologies of the skeletal muscle system, due to a nervous origin of the central nervous system, a traumatic origin or degenerative processes of the peripheral nervous system (ictus or multiple sclerosis).

In particular, the solution is addressed to aged persons, who, being affected by more or less generalized pains of different nature, are no more able to activate their motor capacity. The device of the present invention can also be used in the so-called pain therapy (muscular relaxation).

The efficacy of the apparatus according to the invention is self evident, the advantages being in the possibility of maintaining the desired induced oscillation amplitude, without any frequency limitation, the frequency being able to reach values even of 2000 Hz, and consequently to simultaneously treat many muscular districts, possibly on different patients, with the result of an evident operative inexpensiveness in terms of time and consequently of money and by the fact that the oscillatory wave induction is able to transmit directly to the muscles neuroreceptors, and by the consequent ability of obtaining immediate results even with patients able to produce only a little isometric contraction.

Further, the independence of the single transducers gives the possibility of a correct placement on any single area in proximity of the muscle tendons region, where the mechanical neuroreceptors appointed to interact with the oscillatory event are concentrated. This feature allows for the treatment optimization and for the obtaining of the best results in a very short time.

BRIEF DESCRIPTION OF THE SEVERAL VIEWS OF THE DRAWINGS

The present invention is now disclosed, for illustrative but not limitative purposes, according to its preferred embodiments, by particularly referring to the enclosed figures, in which.

DETAILED DESCRIPTION OF THE INVENTION

Figure 1:
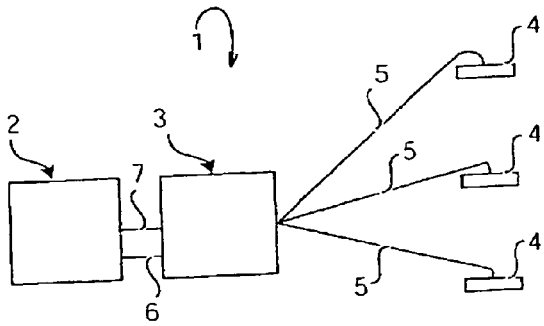
FIG. 1 shows a schematic view of the apparatus for the conditioning of muscular fibrils reaction coordination capacity according to the present invention.

Referring preliminarily to FIG. 1, the apparatus 1 for the conditioning of muscular fibrils reaction coordination capacity is constituted by a compressor 2 and a flux modulator 3, for the production of a sequence of pressure pulses, by a plurality of transducers 4, for the application of said pulses on the skin of a user, in correspondence of the muscle or muscles to be treated, by a plurality of pneumatic conduits 5, for the transmission of said pulses from the system constituted by compressor 2 and modulator 3 to the transducers 4. The compressor 2 and the flux modulator 3 are connected through a first pneumatic conduit 6, connected to the compression exit of the compressor 2 and a second pneumatic conduit 7 connected to the aspiration inlet of the same compressor 2.

Figure 2:
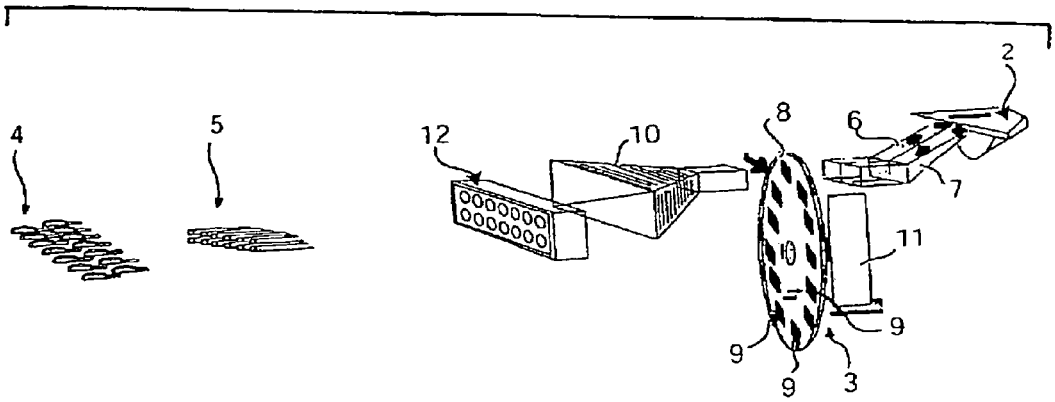
FIG. 2 shows an exploded schematic view of the essential elements of an apparatus for the conditioning of muscular fibrils reaction coordination capacity according to the present invention, incorporating a first type of flux modulator.

FIG. 2 shows in explosion the essential elements of an apparatus 1 for the conditioning of muscular fibrils reaction coordination capacity according to the present invention. In particular, in the embodiment shown in FIG. 2, the flux modulator 3 is constituted by a modulation element 8 having a circular shape and a plurality of passages 9 placed in proximity of its perimeter. The modulation element 8 is interposed between the pneumatic conduits 6 and 7 outlets, respectively connected to the compression outlet and to the aspiration inlet of the compressor 2, and a conduit 20 of a first pneumatic chamber 10. Further, the shape and disposition of passages 9 of the modulation element 8 are chosen so that the conduit 20 of the first pneumatic chamber 10 is in communication alternatively with the compression pneumatic conduit 6 or the aspiration pneumatic conduit 7. In this way the first pneumatic chamber 10 undergoes a sequence of compression and aspiration phases, whose frequency is determined by the rotation velocity of the modulation element 8, which in turn is due to the action of a motor 11, provided with control means.

At the end of the first pneumatic chamber 10 which is opposed to the modulation element 8 is placed a second pneumatic chamber 12, having a variable volume and a plurality of connection openings towards the pneumatic conduits 5 and, through them, to the transducers 4, together with it constitutes a closed circuit, inside which a compressed fluid or an incompressible fluid is located. The second pneumatic chamber 12, a variable volume one, transforms the sequence of compression and aspiration phases to which the pneumatic chamber 10 undergoes as a consequence of the connection determined by the modulation element 8, in a series of mechanic pulses, transmitted through the oscillation of the fluid contained in the closed circuit.

Figure 3:
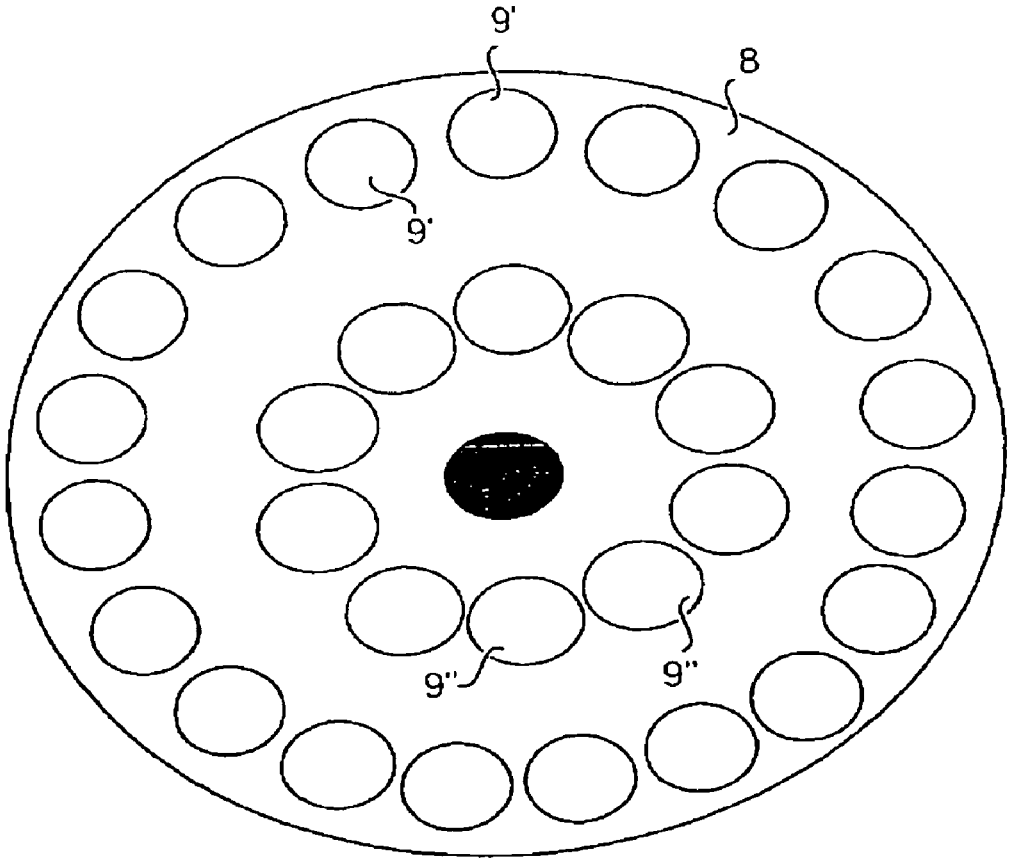
FIG. 3 shows the modulation element of the apparatus shown in FIG. 2.

The FIG. 3 shows an alternative modulation element 8, provided with a first series of passages 9', close to the perimeter of the modulation element 8 and a second series of passages 9", placed in an intermediate position between the centre and the perimeter of the modulation element 8. The function of such a double series of passages is to allow simultaneously the production of pressure pulses with different frequencies, through the same modulator 3. It is possible to connect the first series of passages 9' to a first couple of compression and aspiration pneumatic conduits and the second series of passages 9" to a second couple of compression and aspiration pneumatic conduits. Both couples of compression and aspiration pneumatic conduits can be connected to the same compressor, otherwise to two different compressors.

Figure 4:
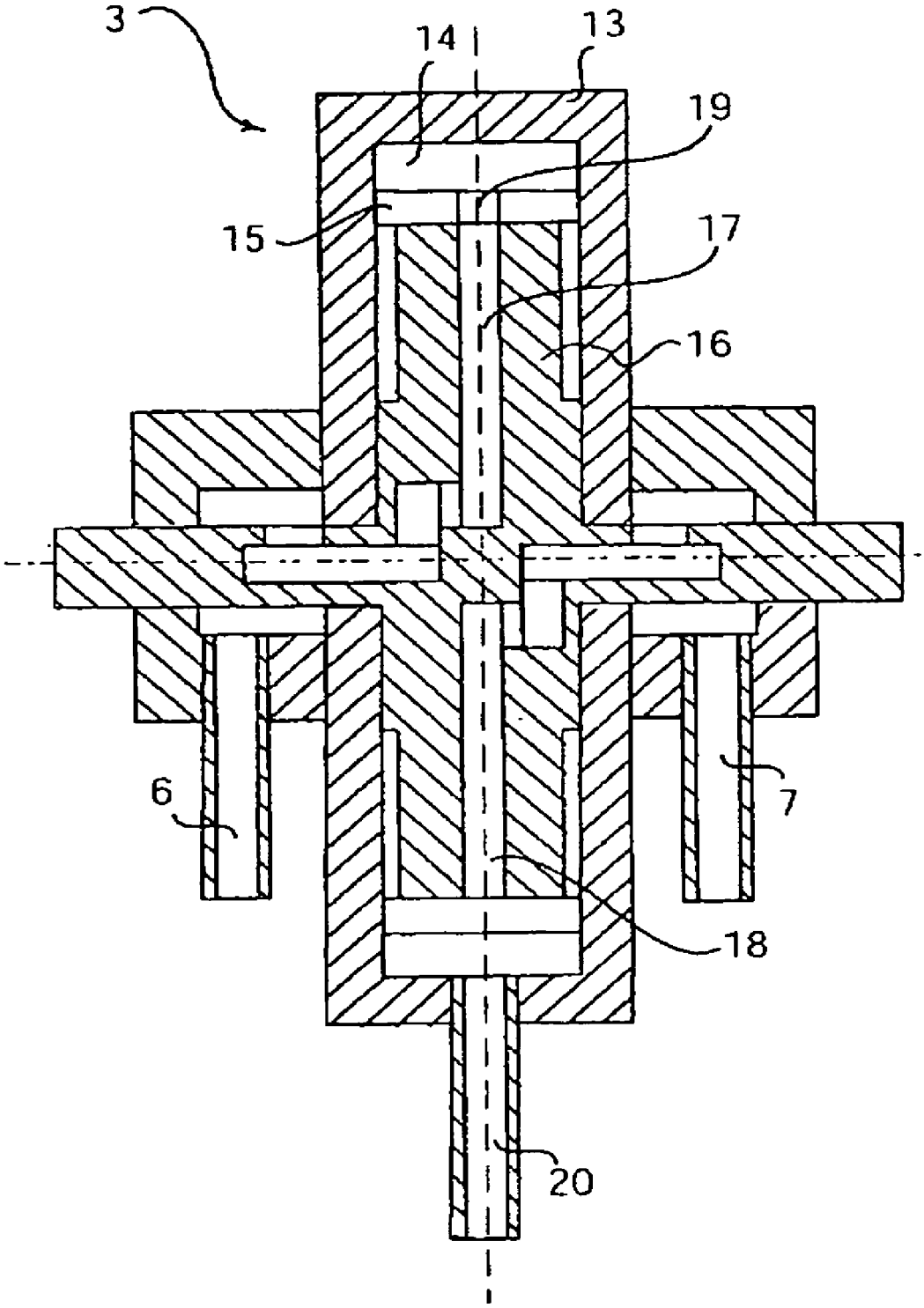
FIG. 4 shows a lateral section view of a second type of flux modulator, for the production of pressure pulses in the apparatus of FIG. 1.
Figure 5:
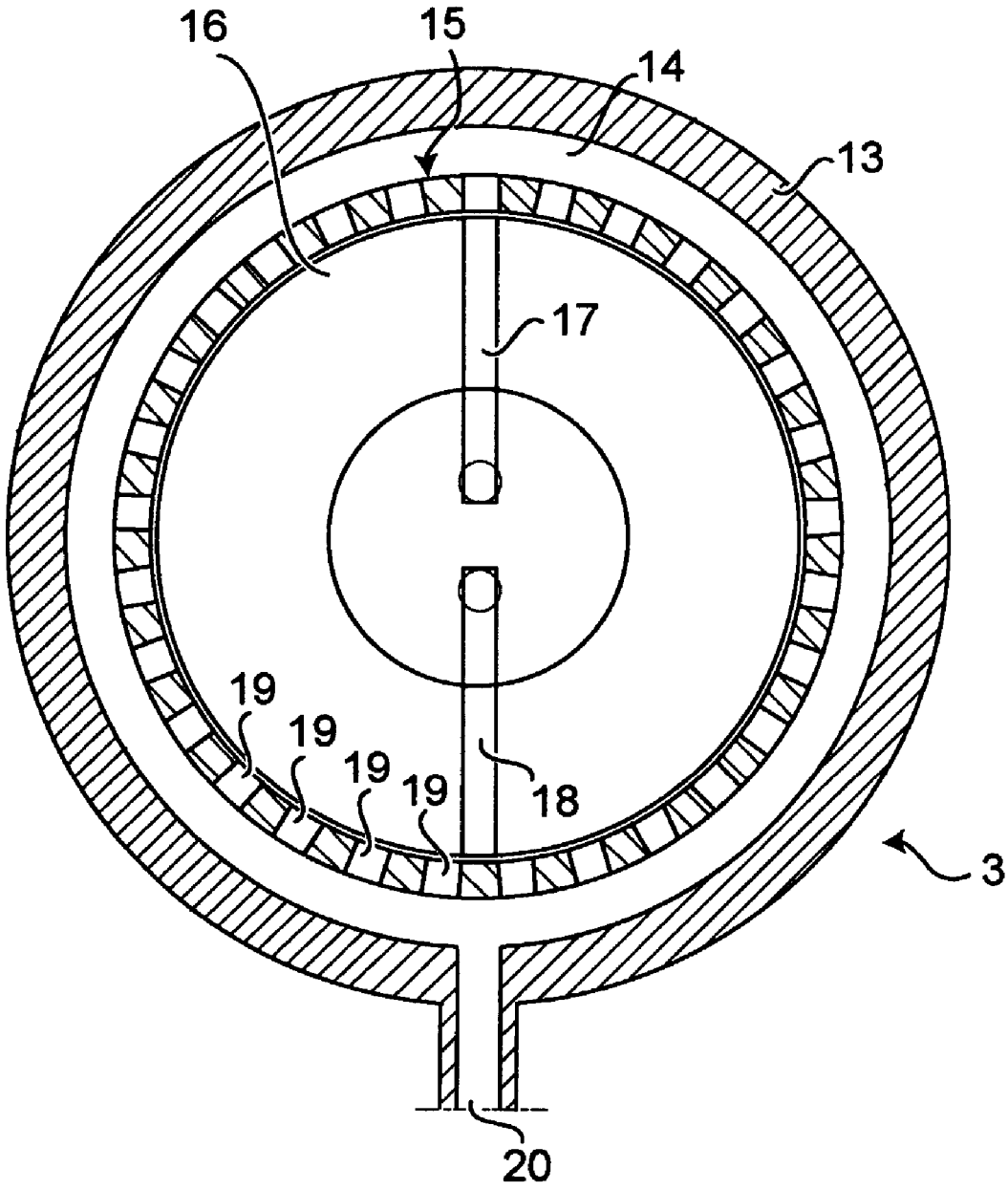
FIG. 5 shows a top plan section view of the flux modulator of FIG. 4.

In the embodiment shown in FIGS. 4 and 5, the flux modulator 3 is constituted by a case 13 inside which a chamber 14 is defined. The chamber 14 is divided, by the modulation element 15, in this case with an annular shape, in two distinct portions, in the central portion of the chamber 14 a rotor 16 being present, in the body of which a first canal 17 and a second canal 18 are realized, respectively connected to a first pneumatic conduit 6, connected to the compression outlet of the compressor 2 and to a second pneumatic conduit 7 connected to the aspiration inlet of the same compressor 2.

The modulation element 15 is provided with a plurality of passages 19. The ends of the first canal 17 (compression) and of the second canal 18 (decompression) are placed substantially in contact with the internal surface of said modulation element 15. The disposition of the ends of canals 17 and 18 with respect to the passages 19 of said modulation element 15 is such that when, during the rotation of the rotor 16, the first canal 17 is in correspondence of a passage 19 of the modulation element 15, the second canal 18 is in correspondence of an area of the modulation element 15 where no passages 19 are present. This way, the portion of said chamber 14, outside the modulation element 15, is linked, through one of the passages 19 of the modulation element 15 and respectively through said first canal 17 and said second canal 18, alternatively to the compression outlet and to the aspiration inlet of the compressor 2. Consequently, inside the chamber 14 a compression or an aspiration is alternatively produced. Through a conduit 20, connecting the chamber 14 to the pneumatic chamber 10, this sequence of phases is transmitted to the pneumatic chamber 10 and, consequently, by means of the series of devices shown with reference to previous figures, to the transducers 4.

Preferably, according to the present invention, the modulation element 15 is provided with is provided with an odd number of passages 19 and said canals 17 and 18 are placed along radial directions rotated by 180°.

Figure 6:
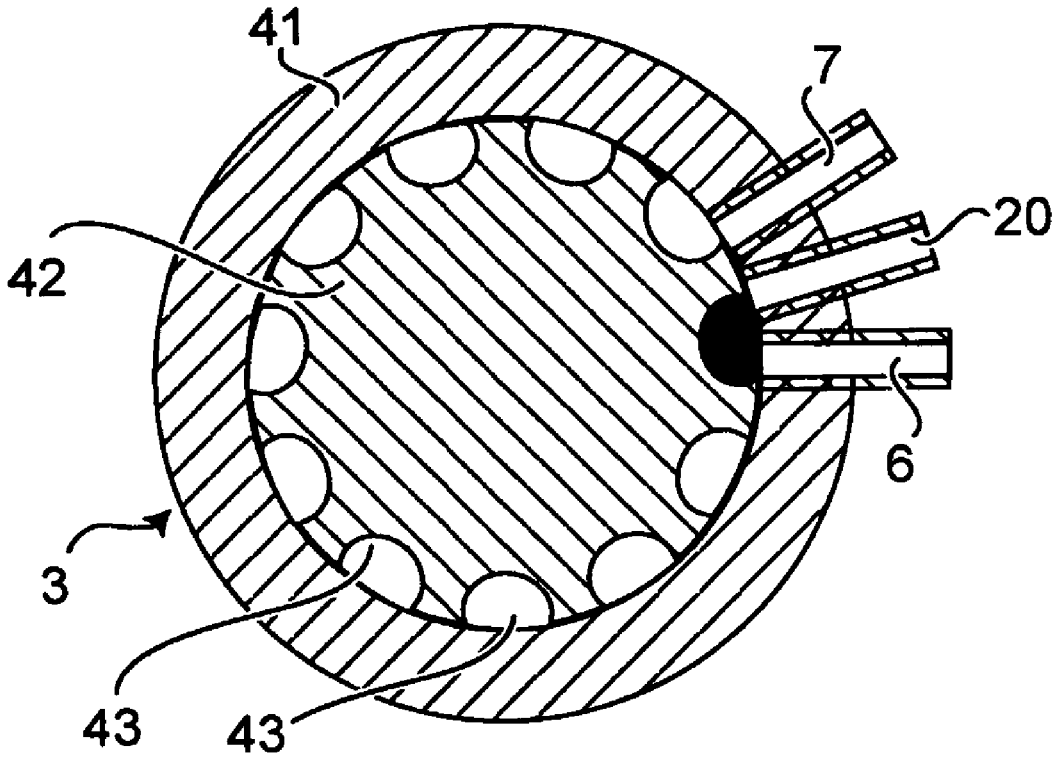
FIG. 6 shows a top plan section view of a third type of flux modulator, for the production of pressure pulses in the apparatus of FIG. 1.

With reference to FIG. 6, a further embodiment of the flux modulator 3 according to the present invention is shown. The fundamental element of the flux modulator 3 is constituted in this case by a hollow cylindrical stator 41, inside which a cylindrical modulation element 42 is present.

In this case, the conduit 20, connected to the pneumatic chamber 10, the first pneumatic conduit 6, connected to the compression outlet of the compressor 2 and the second pneumatic conduit 7 connected to the aspiration inlet of the same compressor 2 are placed adjacent one to the other to the stator 41, the conduit 20 being placed amongst the others. On the lateral surface of the modulation element 42 a plurality of passages 43 is present, having the shape of a curved cavity excavated in the modulation element 42; dimensions, number and relative distance of said passages 43 being such that, during the rotation of the modulation element 42, each passage 43 is able to link the conduit 20 with one at a time of pneumatic conduits 6 and 7.

In a preferred embodiment, a plurality of sets of three conduits of the same type and function of those shown with reference to FIG. 6 can be placed on the stator 41, so that each modulator 3 of this type can be used for the independent connection with a plurality of compressors 2 and/or of pneumatic chambers 10.

It can be easily understood that, in the embodiment of the flux modulator 3 shown in FIG. 2, in that shown in FIGS. 4 and 5, and in that shown in FIG. 6, it is possible, acting on the rotation velocity of the mobile element with respect to the fixed element, to easily change the pressure pulses frequency in the pneumatic chamber 10. Not only, but the solution proposed also allows to reach without any difficulty frequency that are inconceivable by means of the devices available at present (even up to 2000 Hz maintaining a considerable amplitude).

Figure 7:
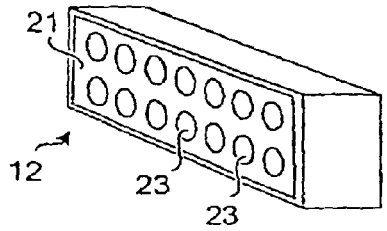
FIG. 7 shows a front perspective view of a variable volume pneumatic chamber, interposable between the flux modulator and the vibration transmission system according to the present invention.
Figure 8:
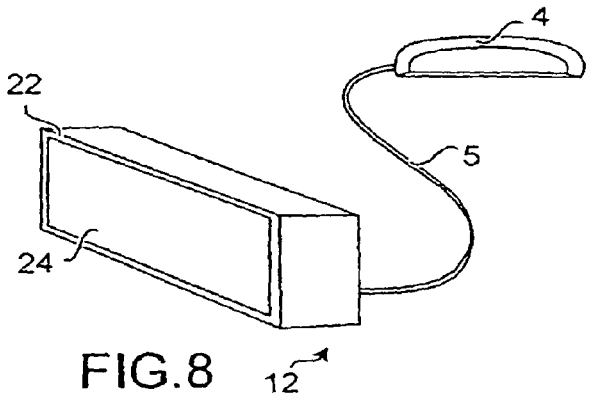
FIG. 8 shows a rear perspective view of the variable volume pneumatic chamber of FIG. 7.

FIGS. 7 and 8 show more in detail the variable volume pneumatic chamber 12. It is constituted by a hollow body, having a first face 21 facing the pneumatic conduits 5 and a second face 22 facing the first pneumatic chamber 10 and the flux modulator 3. Said first face 21 is provided with a plurality of openings 23, each being assigned to the airtight application of a pneumatic conduit 5, while said second face 22 is open and is covered with a membrane 24 in elastic material (preferably an Eastover). In such a way, the internal volume of the variable volume pneumatic chamber 12 can decrease or increase in consequence of the succession of the different compression and aspiration phases in the pneumatic chamber 10, but between the pneumatic chambers 10 and 12 a passage of material is not possible.

Figure 9:
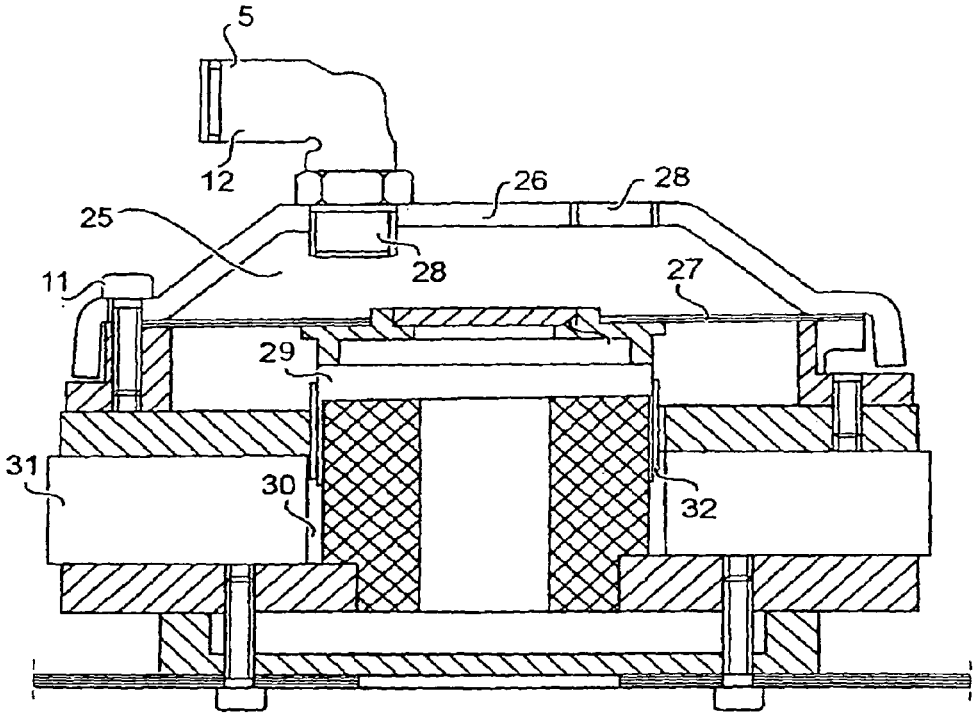
FIG. 9 shows a lateral section view of a fourth type of flux modulator, for the production of pressure pulses in the apparatus of FIG. 1, incorporating a second type of variable volume pneumatic chamber.

FIG. 9 shows an alternative flux modulator 3, for the production of pressure pulses in the apparatus of FIG. 1. The modulator 3 at issue comprises a variable volume pneumatic chamber 25, delimited by a rigid upper cover 26 and by a flexible membrane 27. On the upper cover 26 one or more openings 28 are present, for the connection with the pneumatic conduits 5.

At the centre of the membrane 27 the upper portion of a hollow cylindrical piston 29 is placed, the piston being free to run inside a cylindrical housing 30, realized in the lower part of the flux modulator 3. The cylindrical housing 30 is obtained inside a magnet 31. The lateral surface of the cylindrical piston 29 is covered with a series of coils of an electric cable 32.

Allowing an electric current to pass in the cable 32, the cylindrical piston 29 is attracted or repelled by the magnet 31, depending on the current flow direction, with a force directly proportional to the intensity of the applied electric current.

By alternating the electric current flow direction in the coils, the cylindrical piston 29 is therefore caused to move alternatively up and down, acting on the membrane 27 and consequently lowering or increasing the volume of the pneumatic chamber 25.

In a further embodiment, not shown, the flux modulator is constituted by a body comprising a variable volume pneumatic chamber of the previously seen kind or similar, in which the elastic membrane is replaced by a piezoelectric disc, constituted by piezoelectric ceramic material, fixed to the walls of said pneumatic chamber by means of a couple of metallic rings placed on the perimeter of both faces of said piezoelectric disc, and through supply means of said piezoelectric disc.

Figure 10:
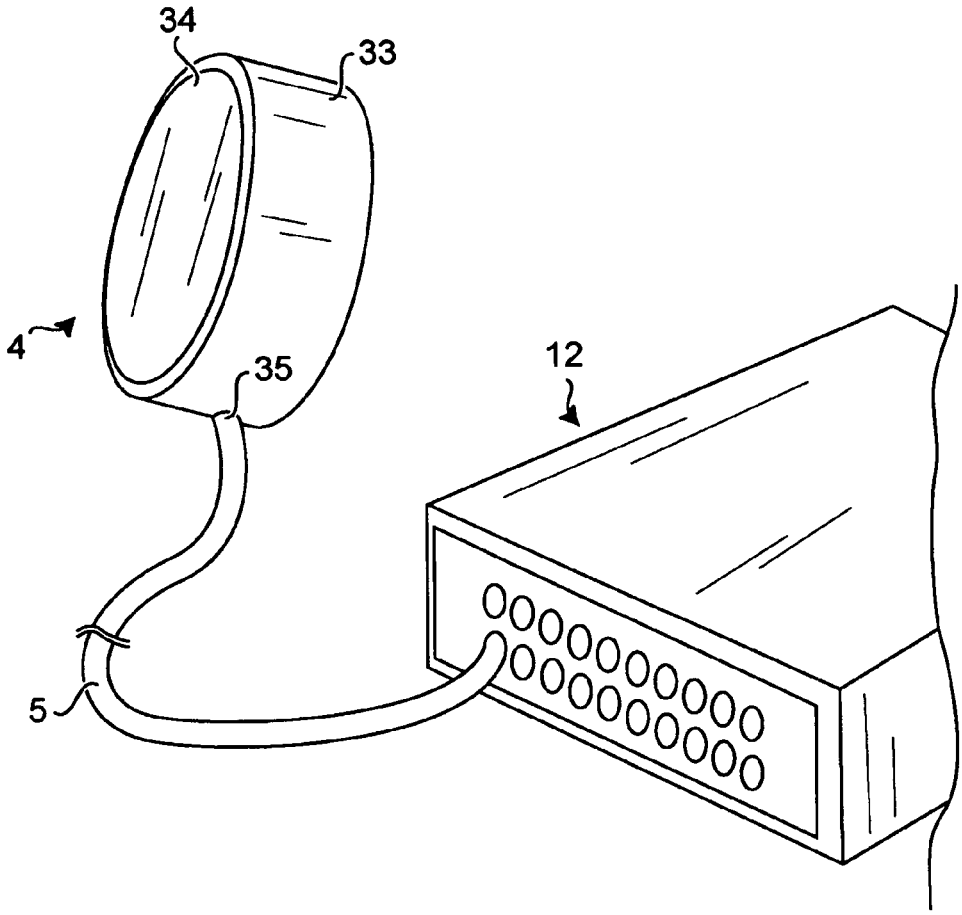
FIG. 10 shows a schematic view of a first type of transducer of the apparatus of FIG. 1, and its connection to the pneumatic chamber of FIGS. 7 and 8.

With reference to FIG. 10, a first embodiment of a transducer 4 according to the present invention is shown, together with the connection of the same with the pneumatic chamber 12, through a pneumatic conduit 5.

Transducers 4 are constituted each by a rigid hollow body 33, with an open side on which a membrane 34 is placed and provided with an opening 35 for the connection with the correspondent transmission conduit 5, so that between the pneumatic chamber 12, the pneumatic conduit 5 and the transducer 4 is constituted an airtight closed circuit. The membrane 34 is preferably realized in a hypoallergenic material, being assigned to the application on the epidermis.

With reference to the closed circuit between the pneumatic chamber 12, the pneumatic conduits 5 and the respective transducers 4, an advantage of the solution according to the present invention is due to the possibility of containing inside this circuit a compressed fluid or also an incompressible fluid, such as water. In fact, the incompressibility of water or the substantial incompressibility of other used fluids avoids the damping to which are otherwise submitted the gases, in particular the air, commonly used in this kind of devices, during the pulse transmission down to the transducers 4. Not only, a transducer 4 full of a liquid or compressed gas does not have shape or amplitude limitations, while the use of non-compressed air, according to the known solutions, requires for the ratio between the section of the transmission conduit 5 and that of the respective transducer 4 not to be too little. An example of a solution that is possible thanks to the present invention is the realization of oblong transducers, which are able to cover the entire muscle, involving a much higher number of mechanoreceptors or mechanical neuroreceptors than the transducers of the known kind.

Figure 12:
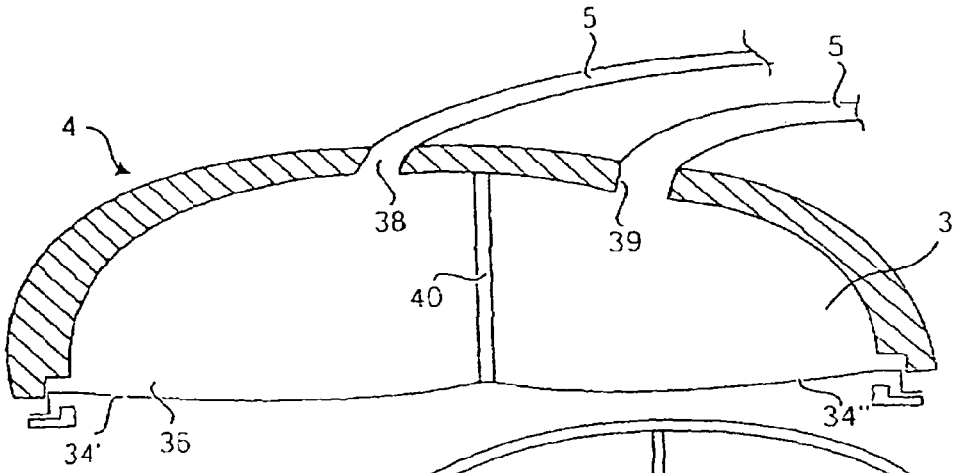
FIG. 12 shows a section view, along line A-A, of the transducer of FIG. 11, FIGS. 13-16 show schematic views of further kinds of flux modulators, for the production of pressure pulses in the apparatus of FIG.
Figure 11:
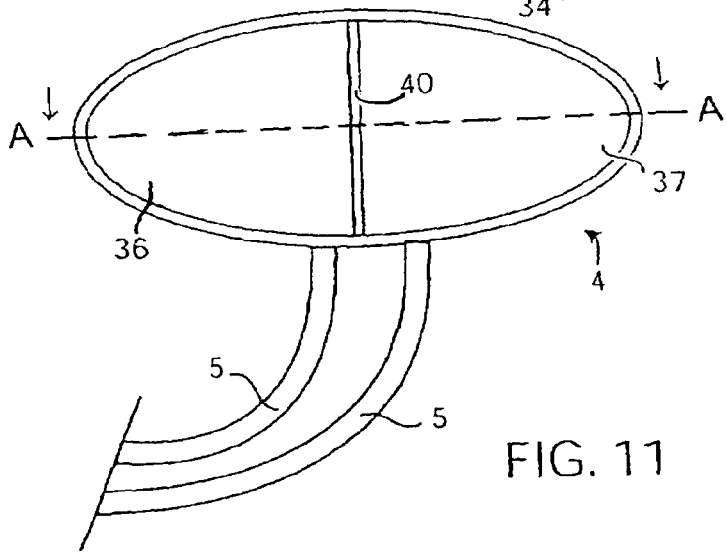
FIG. 11 shows a schematic view of a second type of transducer of the apparatus of FIG. 1.

With reference to FIGS. 11 and 12 it is shown a transducer 4, divided in two chambers 36 and 37 distinct and separate, connected through respective openings 38 and 39, to two different transmission conduits 5. The chambers 36 and 37 are divided by means of a wall 40 and are covered each by a sector 34', 34" of the membrane 34 for contacting the epidermis.

The advantage of realizing multiple chambers transducers 4 consists in the possibility of working at different frequencies on different sectors of the membrane surface in contact with the epidermis (said solution combining for example with the embodiment of the pulse generator rotor shown in FIG. 3). In fact, it is known that the voluntary fibres (striated fibres) and the involuntary fibres (smooth fibres) are sensible to different frequencies (higher for the striated fibres and lower for the smooth ones).

The transducers 4 can be provided with at least a band (not shown) in order to securing the keeping in contact with the epidermis and can be connected to each other in parallel or in series.

Transducers 4 can be connected with said pulse production means so to work in an asynchronous way.

Figure 13:
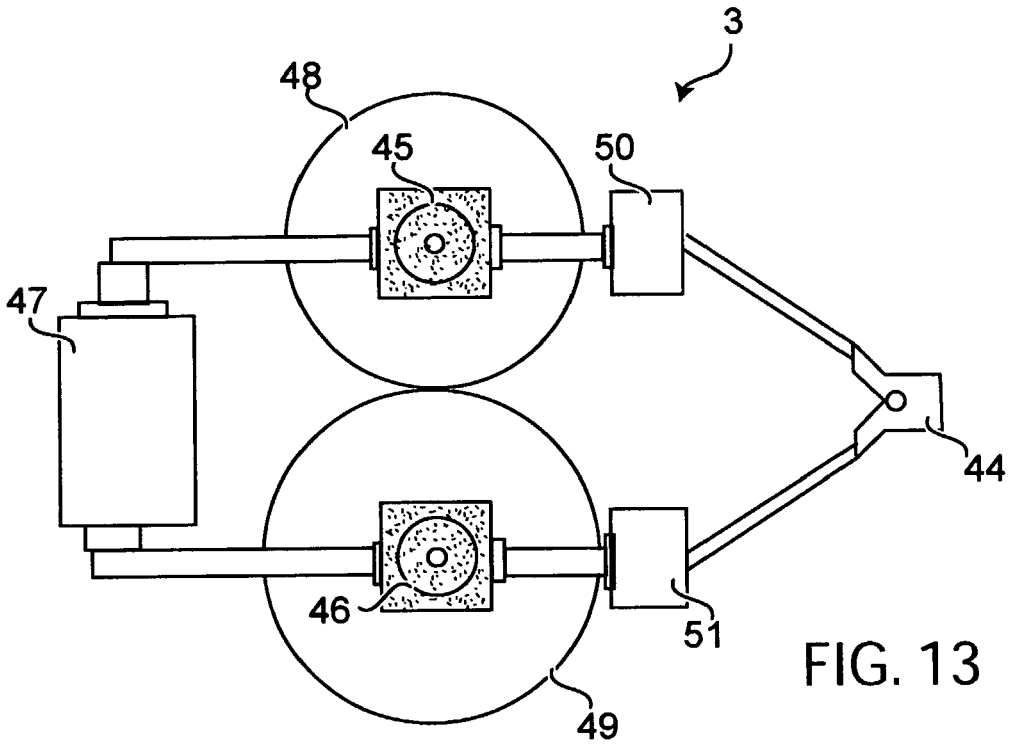

FIGS. 13-16 show some alternative embodiments of the flux modulator 3, wherein the pressure circuit and the aspiration circuit are kept separated from each other down to the single connection points 44 with different pneumatic conduits 5. In particular, FIG. 13 shows a solution in which a rotor 45 and a rotor 46 are present connected respectively on the delivery and on the aspiration of a compressor 47. The rotation of the rotors 45 and 46 is synchronized by means of cogwheels 48 and 49, in contact with each other and respectively integral with the rotors 45 and 46. The realized configuration is such that when the rotor 45 on the pressure line is operative (allows the passage of the pressure fluid), then the rotor 46 on the aspiration line is not operative (passage is prevented). On the pressure and the aspiration line are also shown respective pneumatic chambers 50 and 51, having a variable number of outlets.

Figure 14:
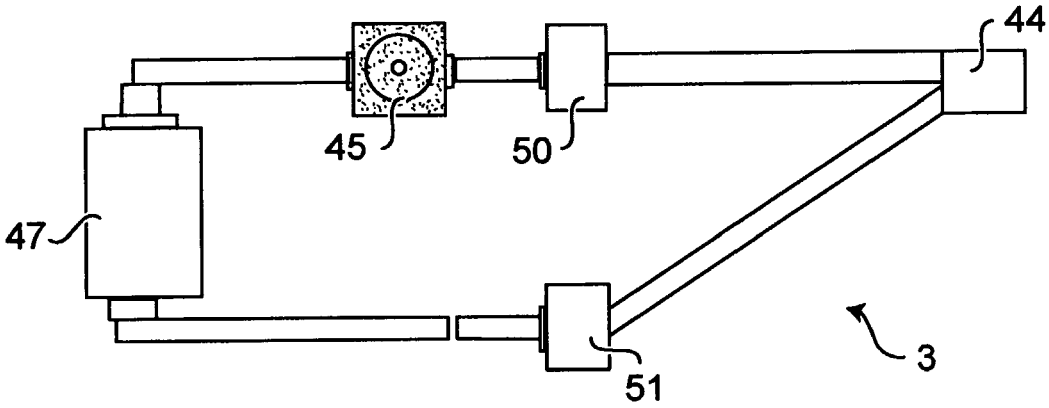

In FIG. 14 it is shown an embodiment in which the rotor on the aspiration line is not present. In this case the aspiration will work continuously.

Figure 15:
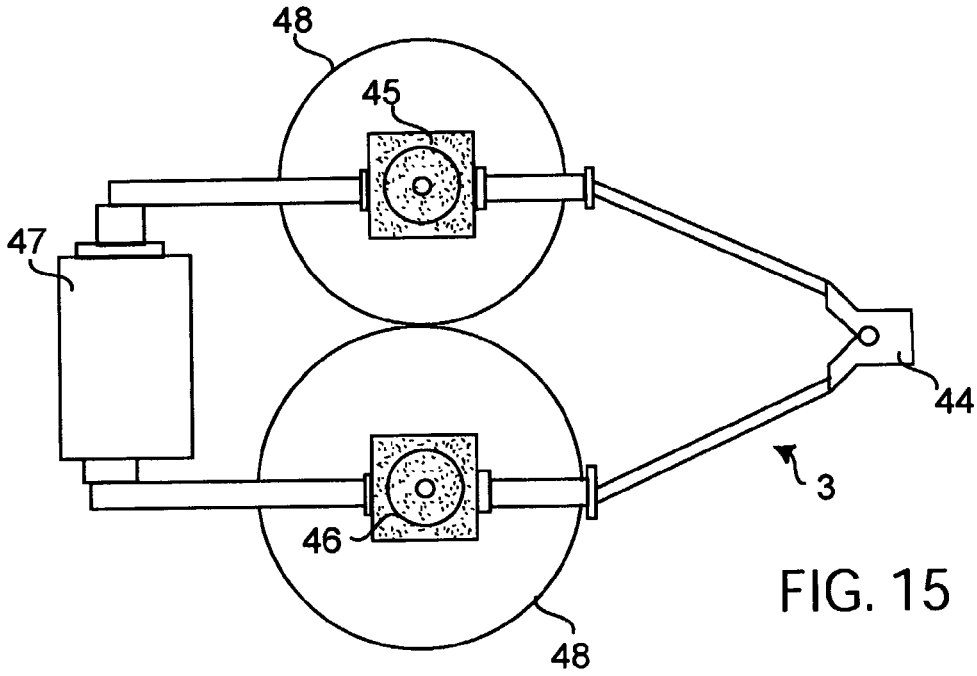
Figure 16:
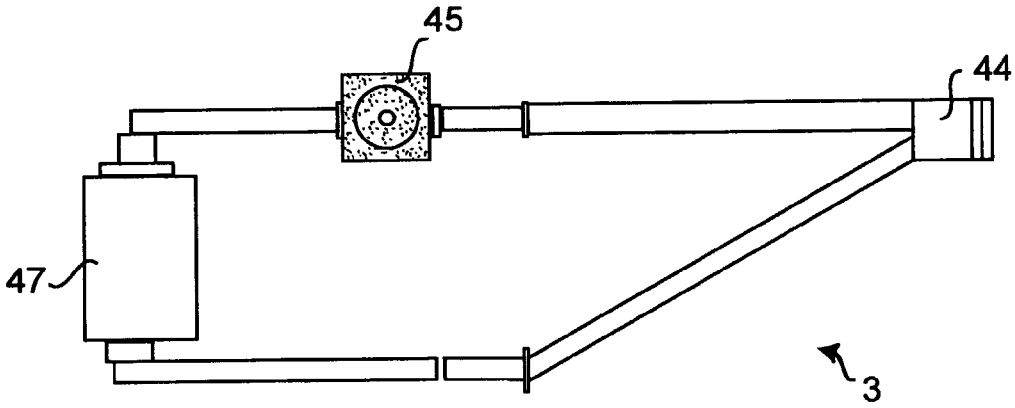

FIGS. 15 and 16 respectively correspond to FIGS. 13 and 14, but are connected to a single pneumatic conduit 5, by making the presence of the pneumatic chamber superfluous. This solution is particularly convenient for using the apparatus in the pain therapy.

Figure 17:
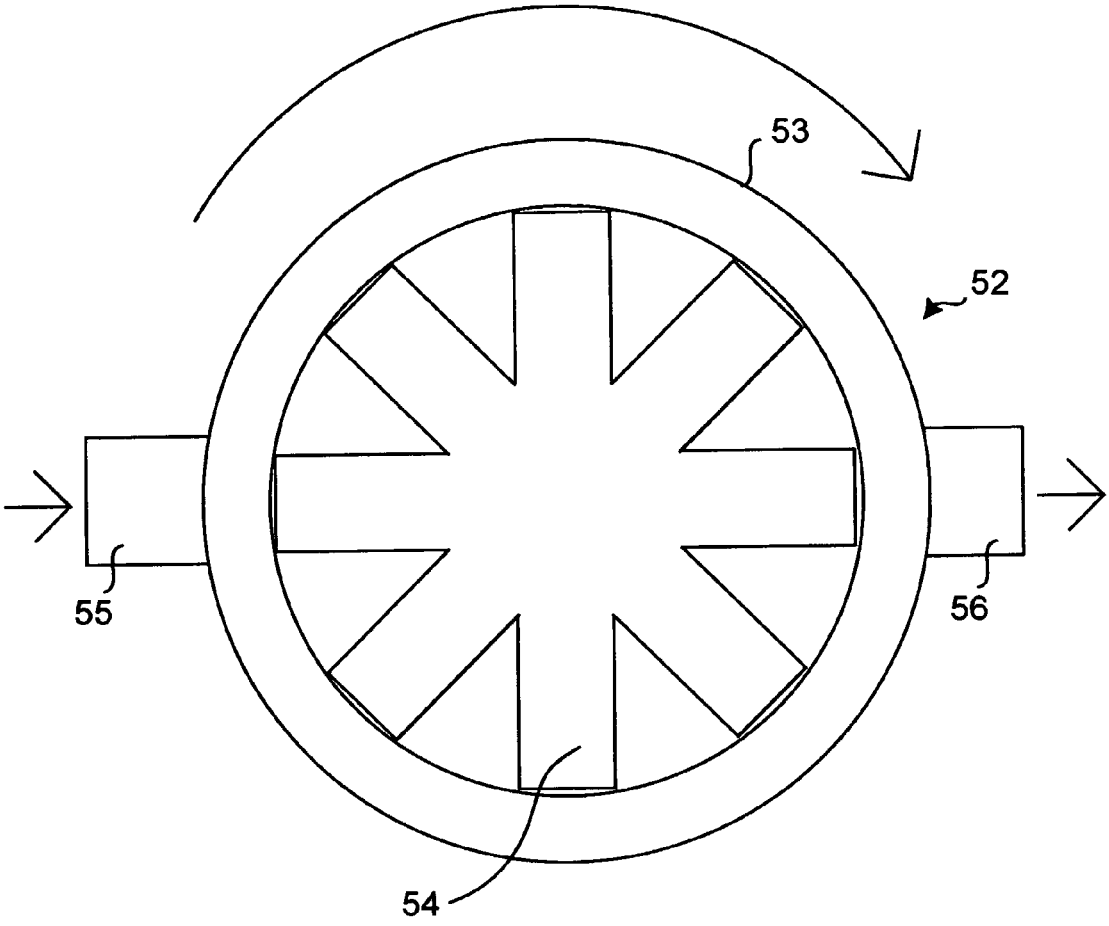
FIG. 17 shows a modulation element of the apparatuses shown in FIGS. 13-16.

FIG. 17 shows an alternative embodiment of the fundamental element of the flux modulator 3, and is constituted in this case by a hollow cylindrical stator 52, inside which a cylindrical shape modulation element 53 is present, crossed by a plurality of radial passages 54. Finally, the inlet conduit 55 and the outlet conduit 56 are shown.

The preferred use of water as a means of transmission of the vibration is due to a series of considerations. First, at the working preferred frequencies of the apparatus according to the present invention, namely frequencies typical of sound waves, the produced pulse propagation velocity is about 320 m/s in the air and about 700 m/s in the water (in the human body the propagation velocity is about 1500 m/s). Since the main problem of this kind of devices consists in the damping of the amplitude of the vibration at the increase of the transmission conduit length, the water presents the first advantage of compensating this dropping with a higher propagation velocity.

The apparatus 1 can further comprise means for regulating the frequency of the vibration and/or means for detecting the muscular reaction to the given impulses, said means for regulating the frequency being automatically regulated by said means for detecting the muscular reaction.

Further, the apparatus 1 can comprise means of automatic elaboration of the vibration frequency cycles.

The frequency of the vibrations applied by means of the apparatus 1 is generally lower than 400 Hertz, preferably is comprised between 10 and 400 Hertz and more preferably is comprised between 40 and 200 Hertz.

The disclosed apparatus allows the conditioning of muscular fibrils reaction coordination capacity by means of a motor exciter pulse, obtained through the application on the muscle in isometric contraction of a mechanical vibration, where the vibration has a frequency comprised between 1 and 400 Hz and is applied in one or more different areas of the same muscle of different muscles.

Further, the apparatus 1 allows for the application on the muscle in isometric contraction of a mechanic vibration, having a frequency comprised between 60 and 150 Hz and is applied in one or more different areas of the same muscle or of different muscles.

Finally, the apparatus 1 allows for the conditioning of muscular fibrils reaction coordination capacity by means of the application on the muscle in isometric contraction of a mechanical vibration, having a frequency comprised between 1 and 400 Hz and is applied in one or more different areas of the same muscle or of different muscles.

The present invention was disclosed for illustrative, but not limitative purposes, according to its preferred embodiments, but it is to be understood that any variation and/or modification can be introduced by those skilled in the field without for this reason departing from the related protection scope, as defined by the enclosed claims.

The invention claimed is:

1. Apparatus for conditioning the coordination capacity of muscle fibrils in response to an original motor exciter pulse, by means of the application to a muscle in isometric contraction of a succession of pressure pulses, said apparatus comprising means for the production of pressure pulses comprising at least a flux modulator, means for the application of said pressure pulses to skin adjacent to the muscle and means for the transmission of said pressure pulses from said means for the production of pressure pulses to said means for the application of said pressure pulses to skin, characterised in that said means for the application of said pressure pulses to skin and said means for the transmission of said pressure pulses from said means for the production of pressure pulses to said means for the application of said pressure pulses to skin constitute a closed circuit inside which a compressed fluid is present said means for the production of pressure pulses further comprise a compressor and said flux modulator comprises a modulation element provided with a plurality of communication passages between a pneumatic chamber having a pneumatic conduit on one side, and a compression conduit and a decompression conduit on the other side, said compression conduit and decompression conduit being respectively connected to a compression outlet and to an aspiration inlet of said compressor, the ends of said compression conduit and said decompression conduit being substantially in contact with a surface of said modulation element, said modulation element being moveable with respect to said compression conduit, said decompression conduit and said pneumatic conduit so that the passages of said modulation element and the ends of said conduits are respectively placed in such a way that when either one of the compression and decompression conduits is positioned so that the compression conduit or the decompression conduit is connected to a passage of the modulation element, the unconnected compression or decompression conduit is connected to said pneumatic chamber conduit, and the other of the compression conduit or the decompression conduit is connected to an area of the modulation element without communication passages.

2. Apparatus according to claim 1, characterised in that said means for the transmission of pressure pulses comprise at least a flexible pneumatic conduit and a variable volume pneumatic chamber, having a hollow rigid body, open on a side, on which an airtight elastic membrane is placed with with at least an opening on the rigid body of the pneumatic chamber for airtight connection with said pneumatic conduit, said airtight elastic membrane being stressed directly or indirectly by said means for the production of pressure pulses.

3. Apparatus according to claim 1, characterised in that said compression conduit and said decompression conduit are placed on a rotating element, turning about an axis coincident with the centre of said modulation element, said modulation element being provided with an odd number of passages.

4. Apparatus according to claim 1, characterised in that said compression conduit and said decompression conduit are fixed, said modulation element turning with respect to them.

5. Apparatus according to claim 1, characterised in that said means for the application of said pressure pulses on the skin comprise one or more transducers consisting each of a body having rigid walls, replaced on the side to be applied to the skin by an airtight membrane, said body having rigid walls and said airtight membrane forming at least a storage chamber for said compressed fluid, said body having rigid walls having an opening for the connection with said means for the transmission of said pulse.

6. Apparatus according to claim 5, characterised by further comprising means for regulation of vibration frequency.

7. Apparatus according to claim 6, characterised by further comprising means for the automatic generation of the vibration frequency cycles.

8. Apparatus according to claim 6, characterised in that the vibration frequency is lower than 400 Hertz.

9. Apparatus according to claim 6, characterised in that the vibration frequency is between 10 and 400 Hertz.

10. Apparatus according to claim 6, characterised in that the vibration frequency is between 40 and 200 Hertz.

11. Apparatus according to claim 5, characterised by further comprising means for detecting a muscular reaction to a given stimulus.

12. Apparatus according to claim 11, characterised in that said apparatus includes means for regulating vibration frequency that is automatically regulated by said means for detecting the muscular reaction.

13. Apparatus according to claim 1 characterised in that said means for the application of said pressure pulses on the skin further comprise at least a band to maintain said means for the application of said pressure pulses in touch with the skin.

* * * * *